United States Patent [19]

Minaire

[11] 3,930,433

[45] Jan. 6, 1976

[54] AUTOMATIC FIREARMS WITH BOLT ASSISTED BY AN ADDITIONAL MASS

[75] Inventor: Jean-Claude Marie Minaire, Saint-Priest-en-Jarez, France

[73] Assignee: Etat Francais, France

[22] Filed: May 17, 1974

[21] Appl. No.: 470,841

[30] Foreign Application Priority Data

June 1, 1973 France ..... 73.19956

[52] U.S. Cl. ..... 89/169; 89/154

[51] Int. Cl.[2] ..... F41D 5/02

[58] Field of Search ..... 89/169, 154

[56] References Cited

UNITED STATES PATENTS

| | | | |
|---|---|---|---|
| 830,511 | 9/1906 | Lehmann | 89/169 |
| 1,985,493 | 12/1934 | Gebauer et al. | 89/169 |
| 2,459,141 | 1/1949 | Balleisen | 89/169 |
| 2,503,575 | 4/1950 | Anderson et al. | 89/169 |

*Primary Examiner*—Samuel Feinberg
*Assistant Examiner*—C. T. Jordan
*Attorney, Agent, or Firm*—Stevens, Davis, Miller & Mosher

[57] ABSTRACT

An automatic firearm has a recoiling bolt connected by an amplifying lever to an additional mass subjected to the action of a recoil spring. One arm of the lever, via a push member, holds in a position of rest a stop pawl which is capable, when it is in active position, of retaining a striking hammer in striking position. The breaking of the lever permits the movement into the active position.

3 Claims, 2 Drawing Figures

AUTOMATIC FIREARMS WITH BOLT ASSISTED BY AN ADDITIONAL MASS

The present invention relates to automatic firearms whose bolt mechanism comprises, in addition to a bolt which recoils upon each shot against the action of return means, an additional mass fastened to said bolt via an amplifying lever which, upon the recoil of the bolt, imparts said additional mass a speed of recoil greater than that of said bolt. The imparting of speed to the said additional mass has the effect of braking the recoil of the bolt (at least at the start of its recoil stroke) in proportions which are an increasing function of the weight of the additional mass and of the multiplication coefficient introduced by the amplifying lever.

The invention relates more particularly, since it is in this case that its application seems to be of the greatest advantage, but not exclusively, among automatic firearms of this type, to those of small caliber and in particular those of the assault rifle or machine pistol type.

Experience has shown that in the case of firearms of this type, the accidental breaking of the amplifying lever during firing generally does not prevent the reloading of the weapon, but on the other hand may upon the next shot cause serious damage to the bolt mechanism, which damage may even go so far as to make the firearm unusable thereafter (ejection towards the rear of the moving parts in particular).

Under these conditions, it will be realized that it would be advisable in the case of firearms of this type instantaneously to stop the firing as soon as an accidental breaking of the amplifying lever takes place, this break generally concerning the root point of the branches of said lever and in particular of the branch bearing the resting surface which is intended to cause the swinging of the lever when it comes against a fixed stop surface at the beginning of the recoil stroke of the bolt.

The object of the invention is specifically to provide an automatic firearm of the type in question, that is to say, one having an additional mass and an amplifying lever, in connection with which an accidental breaking of the amplifying lever instantaneously causes an interruption of the firing, thus avoiding the serious dangers of continued firing with a broken amplifying lever.

The automatic firearm in accordance with the invention comprises, among other parts, a bolt which recoils upon each shot against the action of return means, an additional mass fastened to said bolt via an amplifying lever pivotally mounted on the said bolt and having a resting surface adapted to come into contact with a fixed stop surface at the beginning of the recoil stroke of the bolt, a firing pin slidably mounted in the said bolt, and an oscillating percussion hammer the retraction stroke of which is controlled by the recoil of the bolt and the striking stroke of which is controlled by elastic return means. The automatic firearm being characterized by the fact that it furthermore comprises retention means capable, when they are in active position, of retaining the said percussion hammer in retracted position (and therefore of instantaneously interrupting the firing). The retention means is urged towards the active position by an elastic return device and is positively held in their position of rest, at least during the end of the bolt-closing stroke, by the amplifying lever for as long as the amplifying lever is intact, that is to say, as long as it assures a positive connection between the bolt and the additional mass. The breaking of the amplifying lever (which breakage breaks this positive attachment, causing the amplifying lever to float angularly) has the effect of permitting the said return means to occupy, under the action of their elastic return device, the active position in which they retain the percussion hammer in retracted position, thus automatically assuring an interruption of the firing upon the breaking of the amplifying lever.

The retention means intended to retain the striking hammer in retracted position as soon as an accidental breakage of the amplifying lever takes place are preferably formed by:

a beaked cam keyed at an angle on the oscillating pin of the striking hammer, a stop pawl, articulated on the fixed part of the firearm, adapted to move, under the action of a return spring, from a position of rest in which it is away from the path of the beak of the said cam to an active position in which the stop pawl is located on the portion of the path of the beak corresponding to the start of the striking stroke of the percussion hammer and therefore prevents the said hammer from moving substantially away from its retracted position, and a push member slidably mounted in the fixed portion of the firearm and resting, at one of its ends, on the stop pawl in question and, at its other end, against an arm of the amplifying lever, said assembly being so arranged that at least during the end of the closing stroke of the bolt, the arm, via the push member, forces the stop pawl to remain in its position of rest as long as the amplifying lever is intact.

In accordance with this embodiment, an accidental breaking of the amplifying lever causes the said lever to float at an angle, which permits the stop pawl, under the action of its return spring, to push the said push member back and to assume its active position, in which it locks the percussion hammer in retracted position.

In this embodiment of the invention it is advisable to locate the push member on the side of the arm of the amplifying lever which bears the resting surface intended to cooperate, upon the firing of each shot, with a fixed stop surface at the beginning of the recoil stroke of the bolt, this arm being the one the root of which runs the greatest risk of being broken accidentally.

In order to illustrate the different arrangements, a preferred (but not limitative) embodiment of the invention will now be described with reference to the accompanying drawing in which:

FIG. 1 shows, schematically and in side elevation, with portions in section, the bolt mechanism of an automatic firearm with bolt assisted by an additional mass which is developed in accordance with the invention, the said firearm being shown in operating condition with its bolt closed, FIG. 2 shows, under the same conditions, the said firearm in the position in which it is after the breaking of an amplifying lever forming part of its bolt mechanism.

DESCRIPTION OF THE PREFERRED EMBODIMENT

Figure 1:
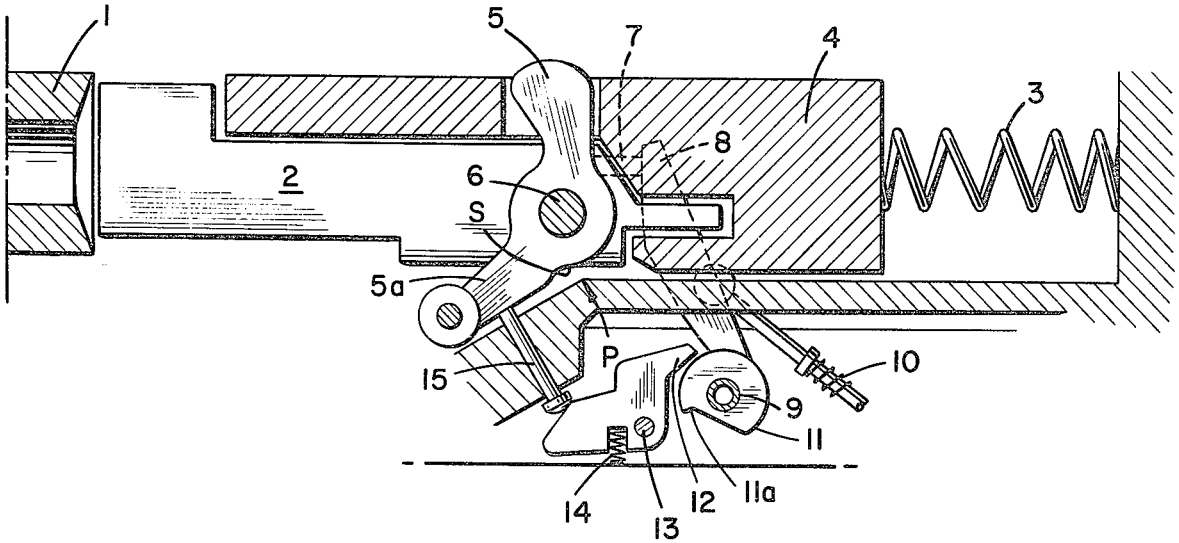

The automatic firearm shown in FIG. 1 is an assault rifle having a launching tube 1, a bolt 2 which recoils upon each shot against the action of a recuperator spring 3, an additional mass 4 (against which the recoil spring 3 rests) secured to said bolt 2 via an amplifying lever 5 which is pivotally mounted around a pin 6 borne by the bolt 2 and having a resting surface S borne by the lower arm 5*a* of the said lever 5 and adapted to come into contact with a stationary stop surface P at the beginning of the recoil stroke of the bolt, a firing pin 7 slidably mounted in the bolt 2, and a swinging striking hammer 8 keyed at an angle onto a pin 9, the retraction stroke of said strike lever 8 being controlled by the recoil of the bolt 2, while the striking stroke of the said lever 8 is controlled by a spring 10.

In accordance with the invention, this bolt mechanism is supplemented by safety means which automatically interrupt the firing in case of the breaking of the amplification lever 5, and particularly in the case of the breaking of the part thereof which is under the greatest stress, namely the root point of its lower arm 5*a* bearing the resting surface S.

The safety means in question comprises:

a cam 11 with beak 11*a* keyed at an angle on the swing pin 9 of the striker hammer 8, a stop pawl 12 pivoted by a pin 13 on a fixed portion of the firearm and subjected to the action of a return spring 14 capable of bringing it into an active position (shown in FIG. 2) in which its nose strikes against the beak 11*a* when the striker hammer 8 starts its striking stroke, the said stop pawl 12 thus retaining the hammer in retracted position, and a push member 15 slidably mounted in the fixed portion of the firearm and resting at one of its ends against the stop pawl 12 and at its other end against the lower arm 5*a* of the amplifying lever 5, this assembly being so arranged that at least during the end of the closing stroke of the bolt 2 and as long as the amplifying lever 5 is intact, the said lower arm 5*a*, via the push member 15, forces the stop pawl to remain in its position of rest (shown in FIG. 1) in which it permits the oscillations of the cam 11 and therefore those of the striker hammer 8 which is connected at an angle to said cam.

Figure 2:
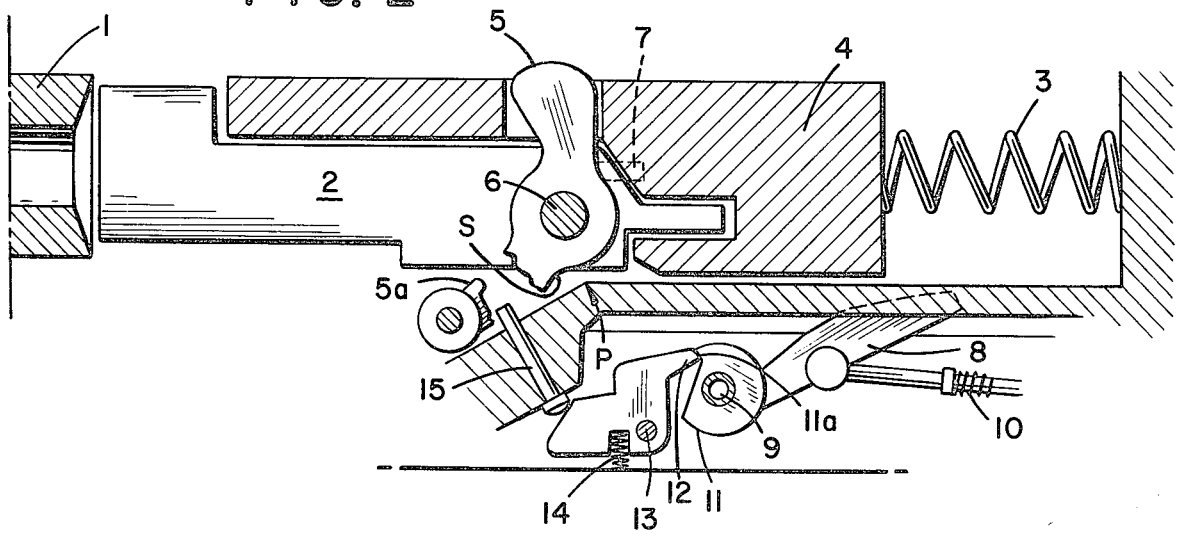

In case of the breaking of the amplifying lever 5, and particularly its lower arm 5*a*, as shown in FIG. 2, the push member 15 slides toward the broken lever 5 and the spring 14 becomes predominant and causes the stop pawl 12 to swing into the active position in which it blocks the percussion hammer 8 in retracted position, thus assuring the interruption of the firing.

As goes without saying and as furthermore is already evident from the foregoing, the invention is by no means limited to those of its methods of application and embodiments which have been more particularly contemplated; rather, it covers all possible variants.

I claim:

1. An automatic firearm comprising:

a bolt which recoils upon each shot against the action of return means, an amplifying lever pivotally mounted on said bolt, said lever having a resting surface adapted to come into contact with a fixed stop surface at the start of the recoil stroke of the bolt, an additional mass connected to said bolt by said amplifying lever, a firing pin slidably mounted in said bolt, a pivoting striking hammer the retraction stroke of which is controlled by the recoil of the bolt and the striking stroke of which is controlled by elastic return means, means for retaining said striking hammer in retracted position when in an active position, said retaining means being urged towards the active position by an elastic return device and being held in a position of rest, at least during the end of the closing stroke of the bolt, by said amplifying lever as long as said amplifying lever maintains the connection between the bolt and the additional mass, the breaking and said amplifying lever, causing said anplifying lever to float at an angle, permits said retaining means to come, under the action of the elastic return device, into the active position for retaining the striking hammer in retracted position, thus automatically assuring an interruption of firing.

2. A firearm as claimed in claim 1, wherein:

said striking hammer is pivotable about a swing pin, and said retaining means comprises:

a cam, said cam having a beak keyed at an angle on the swing pin of the striking hammer, a stop pawl pivoted on a pin on a fixed portion of the firearm, said stop pawl being adapted to move, under the action of said elastic return device, from a position of rest in which it is outside the path of the beak of said cam to an active position in which said stop pawl is on a portion of the path of said beak corresponding to the start of the striking stroke of the striking hammer and therefore prevents said hammer from moving substantially away from its retracted position, and a push member slidably mounted in said fixed portion of the firearm and resting, at one of its ends against said stop pawl and, at its other end, against an arm of said amplifying lever so that, at least during the end of the closing stroke of the bolt, said arm by said push member forces said stop pawl to remain in its position of rest as long as the amplifying lever maintains the connection between the bolt and the additional mass.

3. A firearm as claimed in claim 2, wherein:

the push member is located on the same side as the arm of the amplifying lever.

* * * * *